US008486541B2

(12) United States Patent
Brent et al.

(10) Patent No.: US 8,486,541 B2
(45) Date of Patent: Jul. 16, 2013

(54) CO-SINTERED MULTI-SYSTEM TUNGSTEN ALLOY COMPOSITE

(75) Inventors: Timothy J. Brent, Johnson City, TN (US); Michael T. Stawovy, Cleveland Heights, OH (US)

(73) Assignee: Aerojet-General Corporation, Rancho Cordova, CA (US)

( * ) Notice: Subject to any disclaimer, the term of this patent is extended or adjusted under 35 U.S.C. 154(b) by 1527 days.

(21) Appl. No.: 11/811,949

(22) Filed: Jun. 12, 2007

(65) Prior Publication Data

US 2008/0102303 A1 May 1, 2008

Related U.S. Application Data

(60) Provisional application No. 60/815,730, filed on Jun. 20, 2006.

(51) Int. Cl.

| | |
|---|---|
| ***C22C 27/04*** | (2006.01) |
| ***B32B 15/04*** | (2006.01) |
| ***B32B 15/18*** | (2006.01) |
| ***B32B 15/20*** | (2006.01) |
| ***F02K 9/00*** | (2006.01) |

(52) U.S. Cl.

USPC ..... 428/614; 428/546; 428/665; 244/158.1; 420/430

(58) Field of Classification Search

USPC ..... 428/546, 548, 567, 569, 614, 665

See application file for complete search history.

(56) References Cited

U.S. PATENT DOCUMENTS

| | | | | |
|---|---|---|---|---|
| 3,863,337 | A * | 2/1975 | Schreiner et al. | 29/875 |
| 3,929,424 | A * | 12/1975 | Krock et al. | 428/569 |
| 3,988,118 | A | 10/1976 | Grierson et al. | 29/182 |
| 4,762,559 | A | 8/1988 | Penrice et al. | 75/248 |
| 4,784,690 | A | 11/1988 | Mullendore | 75/248 |
| 4,851,042 | A | 7/1989 | Bose et al. | 75/248 |
| 4,958,569 | A | 9/1990 | Mandigo | 102/476 |
| 4,981,512 | A * | 1/1991 | Kapoor | 75/248 |
| 5,032,353 | A * | 7/1991 | Smarsly et al. | 419/12 |
| 5,098,487 | A | 3/1992 | Brauer et al. | 148/432 |
| 5,279,787 | A * | 1/1994 | Oltrogge | 419/38 |
| 5,298,339 | A | 3/1994 | Aghajanian et al. | 428/614 |
| 5,427,735 | A * | 6/1995 | Ritter et al. | 419/47 |

(Continued)

FOREIGN PATENT DOCUMENTS

WO 92/20481 11/1992

OTHER PUBLICATIONS

Brown et al., "Prospects for the Application of Tungsten as a Shaped Charge Liner Material", *Tungsten & Tungsten Alloys—1992*, edited by Bose et al, Metal Powder Industries Federation, 1992, at pp. 447-454.

*Primary Examiner* — Michael La Villa

(74) *Attorney, Agent, or Firm* — Wiggin and Dana LLP; Gregory S. Rosenblatt

(57) ABSTRACT

A composite is produced by the steps of (a) blending a first mixture of metallic powders; (b) compacting the blended first mixture of metallic powders to a plurality of discretely shaped articles; (c) blending a second mixture of metallic powders; (d) mixing the plurality of discretely shaped articles with the blended second mixture of metallic powders to form a precursor blend; (e) compacting the precursor blend; and (f) sintering the precursor blend. The composite has a metallic matrix with embedded shapes dispersed throughout the matrix where the embedded shapes have an incipient liquid phase sintering temperature less than an incipient liquid phase sintering temperature of the matrix.

6 Claims, 3 Drawing Sheets

U.S. PATENT DOCUMENTS 5,842,108 A * 11/1998 Kim et al. ..... 419/33
5,939,664 A * 8/1999 Kapoor ..... 102/506
5,989,494 A * 11/1999 Kapoor ..... 419/54
6,149,708 A * 11/2000 Kepplinger et al. ..... 75/446
6,368,376 B2 * 4/2002 Hong et al. ..... 75/235
6,393,991 B1 5/2002 Funston et al. ..... 102/476
6,527,880 B2 3/2003 Amick ..... 148/423
6,823,798 B2 11/2004 Amick ..... 102/517
6,827,756 B2 12/2004 Park et al. ..... 75/248
6,845,719 B1 * 1/2005 Spencer ..... 102/519
6,960,319 B1 11/2005 Kapoor ..... 419/11
2005/0123433 A1 * 6/2005 Li et al. ..... 419/36
2005/0241522 A1 11/2005 Stawovy ..... 102/476
2007/0053785 A1 3/2007 Hetz et al.
2008/0047458 A1 * 2/2008 Storm et al. ..... 102/501

* cited by examiner

CO-SINTERED MULTI-SYSTEM TUNGSTEN ALLOY COMPOSITE

CROSS REFERENCE TO RELATED APPLICATION(S)

This patent application claims priority to U.S. Provisional Patent Application Ser. No. 60/815,730, titled "Co-Sintered Multi-System Tungsten Alloy Composite," that was filed on Jun. 20, 2006. The subject matter of that provisional patent application is incorporated by reference in its entirety herein.

U.S. GOVERNMENT RIGHTS

N.A.

BACKGROUND OF THE INVENTION

1. Field of the Invention

This invention relates to a composite material and a method for the manufacture of that composite material. The composite material has discrete liquid phase sintered tungsten heavy alloy shapes embedded in a solid state sintered matrix. Both the liquid phase sintering of the embedded shapes and the solid state sintering of the matrix are performed at the same temperature using a single co-sintering process. The co-sintering process allows for uniform sintering shrinkage of the embedded shapes and the surrounding matrix and thereby avoids the formation of defects such as pores and cracking that can occur by conventional processes. In one embodiment, the composite is formed into a component for a fragmentation device having sufficient strength and generating sufficient momentum to penetrate fortified defenses prior to detonation. On detonation, the component releases discrete, high density fragments.

2. Description of the Related Art

The military has a need for devices that can be deployed from a safe distance and distribute a lethal cloud of fast-moving fragments on detonation. Such devices presently use an embossed steel shell that breaks apart along a pattern of thin sections on detonation. Due to the relatively low density of steel, this configuration is not effective for penetrating defensive fortifications, such as concrete or steel lined bunkers, prior to detonation.

Momentum is a function of (mass)×(velocity). Accordingly, shaped charge liners and fragmentation devices are frequently formed from a tungsten-base alloy. Commonly owned U.S. Pat. No. 7,360,488 titled "Single Phase Tungsten Alloy for Shaped Charge Liner," issued Apr. 22, 2008, discloses a cast metal alloy for forming a shaped charge liner, fragmentation warhead, warhead casing and the like that is an alloy of cobalt, tungsten and nickel. U.S. Pat. No. 6,960,319 titled "Tungsten Alloys for Penetrator Application and Method of Making Same" discloses a kinetic energy penetrator formed from an alloy of tungsten, one or more elements selected from the group consisting of nickel, iron, chromium and cobalt and one or more elements selected from the group consisting of titanium and aluminum. The kinetic energy penetrator is formed by blending a mixture of the powdered elemental components or alloys and then consolidating by solid state sintering. U.S. Pat. No. 6,827,756 titled "Tungsten Heavy Alloy for Penetrating Splinter Shell and Forming Method Thereof" discloses a tungsten-molybdenum-nickel-iron shell formed by compacting elemental or alloy powders of the desired composition to form a green blank and then liquid phase sintering to consolidate. All three of U.S. Pat. Nos. 7,360,488, 6,960,319 and 6,827,756 are incorporated by reference in their entireties herein.

There remains, therefore, a need for a high density, high strength, component for a fragmentation device that does not have the limitations of the prior art.

BRIEF SUMMARY OF THE INVENTION

In accordance with the invention, there is provided a composite metal component. This composite has a metallic matrix and embedded shapes dispersed throughout the matrix where the embedded shapes have an incipient liquid phase sintering temperature less than the incipient liquid phase sintering temperature of the matrix.

In one embodiment of the invention, the composite is produced by the steps of (a) blending a first mixture of metallic powders; (b) compacting the blended first mixture of metallic powders to a plurality of discretely shaped articles; (c) blending a second mixture of metallic powders; (d) mixing the plurality of discretely shaped articles with the blended second mixture of metallic powders to form a precursor blend; (e) compacting the precursor blend; and (f) sintering the precursor blend.

The details of one or more embodiments of the invention are set forth in the accompanying drawings and the description below. Other features, objects and advantages of the invention will be apparent from the description and drawings, and from the claims.

BRIEF DESCRIPTION OF THE DRAWINGS

Like reference numbers and designations in the various drawings indicated like elements.

DETAILED DESCRIPTION

Throughout this patent application, the following definitions are employed.

Incipient Liquid Phase Sintering Temperature—the minimum temperature effective for liquid phase sintering of a metallic compact.

Liquid phase sintering—sintering of a compact or loose powder aggregate under conditions where a liquid phase is present during part of the sintering cycle.

Solid state sintering—a sintering procedure for compacts or loose powder aggregates during which no component melts.

Tungsten-base—an alloy or other mixture of metals having a minimum of 50%, by weight, of tungsten.

Figure 1:
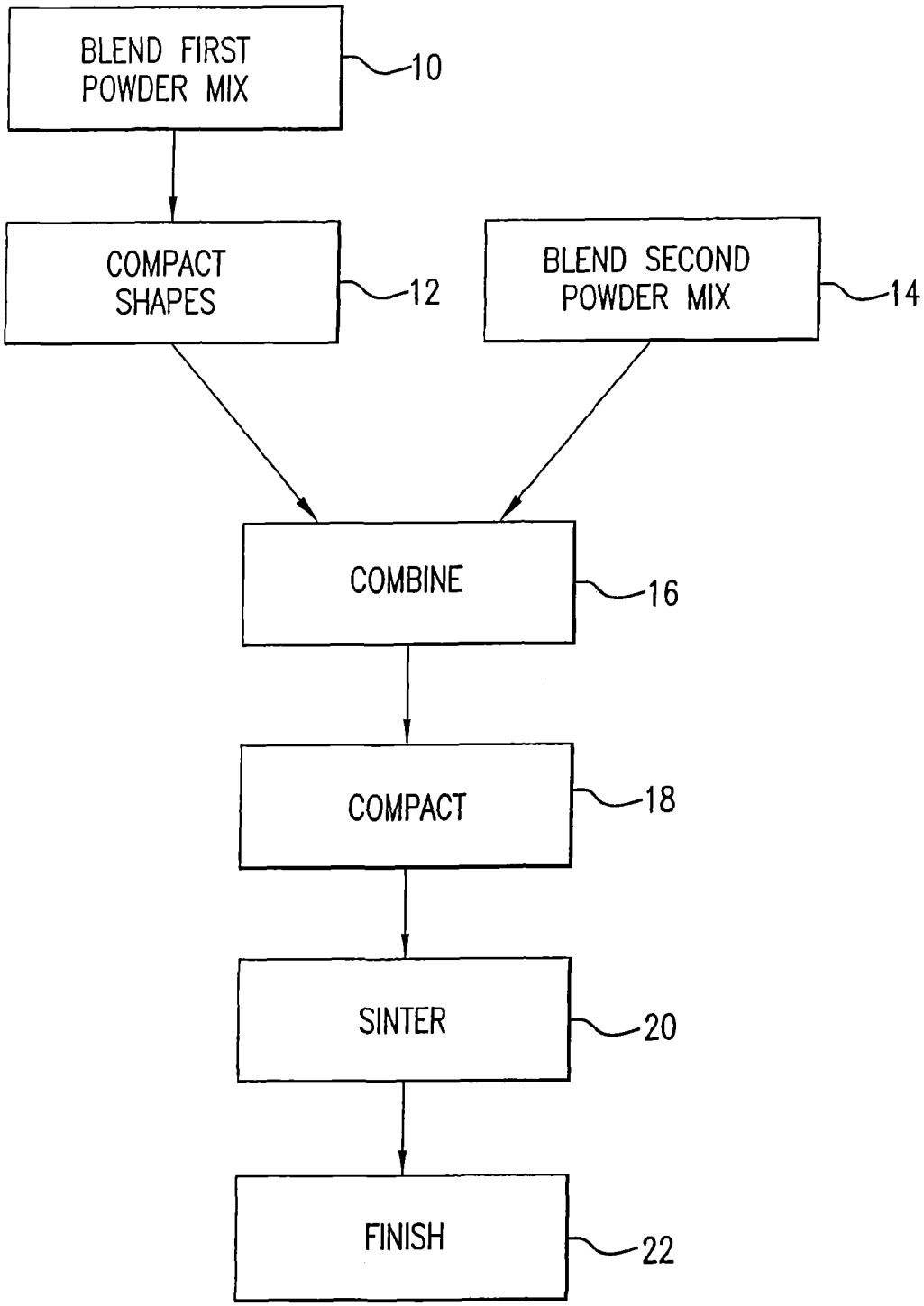
FIG. 1 illustrates in flow chart representation a method for the manufacture of a composite metal component in accordance with the invention.

FIG. 1 illustrates in flow chart representation a method for the manufacture of a composite metal component in accordance with the invention. A first mixture of metallic powders is blended 10 to form a substantially homogeneous mixture. The powder constituents of this first powder mix are selected to have a liquid phase sintering temperature less than the liquid phase sintering temperature of a second powder mix, but above the solid state sintering temperature of the second powder mix as described hereinbelow. To enhance the momentum of the composite metal component, the first powder mix preferably includes significant amounts of one or more high density metallic constituents. Most preferably, the first powder mix is tungsten-base, molybdenum-base, or a mixture of tungsten- and molybdenum-base. Alloys and compounds of these metals, such as ferrotungsten, may also be employed. In addition, one or more elements that depress the melting temperature of the powder mix are present. Such melting point depressors include copper, cobalt, manganese and combinations of metals with a melting point less than the matrix material.

The blended first powder mix is then compacted 12 into a desired shape. This shape may be spheres, cubes, rectangular blocks or some other desired configuration with a diameter or major axis length of at least 2 millimeters and typically in the range of 2 mm to 50 mm. Typically, the blended first powder mix will be inserted into a die cavity having the desired shape and then compacted under a pressure of from about 200 MPa to 700 MPa forming a green compact of the desired shape.

A second powder mix is then blended 14 to form a mixture having a liquid phase sintering temperature higher than the liquid phase sintering temperature of the first powder mix and a solid state sintering temperature less than the liquid phase sintering temperature of the first powder. To enhance momentum, the second powder mix is preferably predominantly formed of high density metals such as tungsten and molybdenum. Most preferably, the second powder mix is tungsten-base, molybdenum-base or a mixed tungsten- and molybdenum-base. Alloys and components of these metals, such as ferrotungsten, may also be used. In one embodiment, the second powder mix is a tungsten heavy alloy (WHA) matrix with a composition, by weight, of 10% to 100% tungsten and the balance nickel, iron, cobalt and/or copper. The first powder mix and the second powdered mix are selected such that the incipient liquid phase sintering temperature of the first powder mix is at least 10° C. less than the incipient liquid phase sintering temperature of the second powder mix and more preferably, the temperature differential is from 20° C. to 50° C. The melting temperature differential is essential as co-sintering of the first powder mix and the second mix without this differential will result in a homogeneous microstructure.

The blended second powder mix 14 and compacted shapes 12 are then combined 16 to form a substantially homogeneous suspension of compacted shapes 12 in the second powder mix. The ratio of compacted shapes to second powder mix can be from about 10% to 70% by weight such that the compacted shapes form a discontinuous second phase of embedded shapes in a matrix formed of the second powder mix. The combination is then compacted 18, such as by placing the mix in a die of a desired shape and compacting under a pressure of from 200 MPa to 700 MPa to form a green compact. This green compact is then sintered 20 at a temperature which meets all three of the following requirements: (a) above the incipient liquid phase sintering temperature of the embedded shapes of the first powder; (b) below the incipient liquid phase sintering temperature of the second powder mix; and (c) above the incipient solid state sintering temperature of the second powder mix. A typical sintering 20 temperature is between 1200° C. and 1350° C. and preferably between 1225° C. and 1275° C.

The sintered composite metal component may be used as is or finished 22 by additional forming or machining to form the component of the desired configuration.

Figure 2:
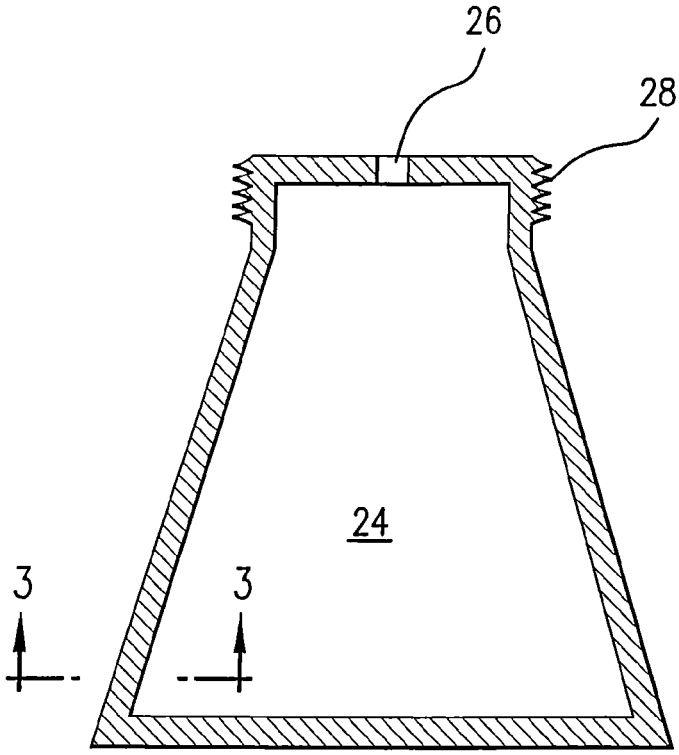
FIG. 2 illustrates a nosecone component formed from the composite metal component of the invention.

The composite metal component is particularly suited for formation into a nose cone for a fragmenting warhead 24 as shown in cross-sectional representation in FIG. 2. Subsequent to sintering, additional features such as apertures 26 and threads 28 may be added during the finishing step.

Figure 3:
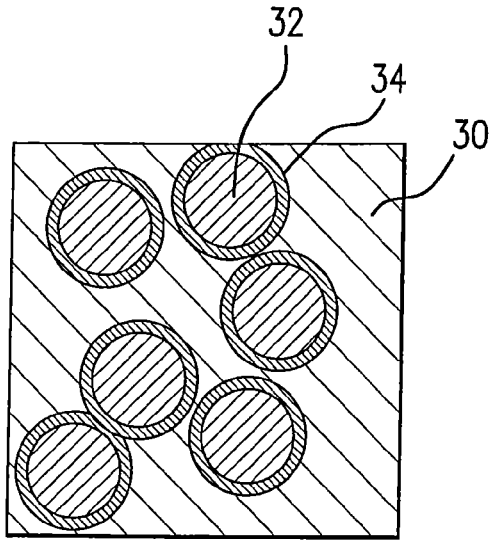
FIG. 3 illustrates a portion of the nosecone component of FIG. 2 in magnified cross-sectional view.

FIG. 3 illustrates in magnified cross-sectional view, a portion of the composite metal component formed into the nose cone 24 of FIG. 2. The composite metal component includes a metallic matrix 30 and embedded shapes 32 dispersed throughout the matrix. Following sintering in accordance with the invention, the matrix 30 has a microstructure commensurate with solid state sintering and the embedded shapes 32 have a microstructure commensurate with liquid phase sintering. An intermetallic rich diffusion layer 34 bonds the matrix and embedded shapes. On detonation, the matrix fragments release the embedded shapes as high momentum shrapnel. The intermetallic phase also aids in the fracture and separation of the embedded shapes into discrete fragments.

The advantages of the invention will become more apparent from the examples that follow.

EXAMPLES

Example 1

Figure 4:
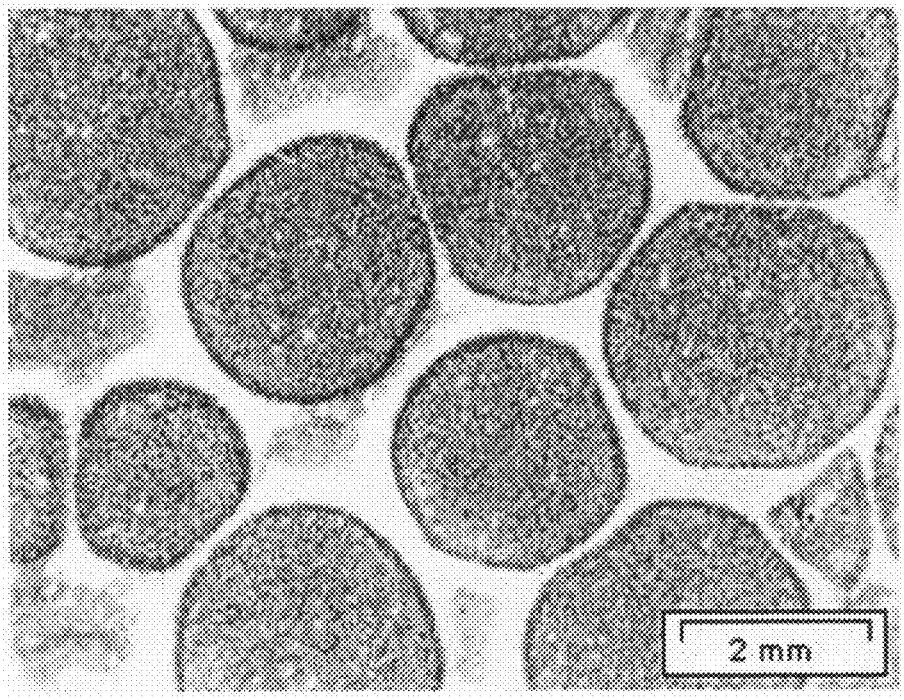
FIG. 4 is a photomicrograph illustrating the structure of the composite of the invention.

Two grain spheres compacted from, by weight, 95% tungsten-3% nickel-2% copper were embedded in a matrix of, by weight, 72.2% tungsten-19.5% nickel-8.3% iron and sintered at 1250° C. for 5 hours in a hydrogen atmosphere. The resulting microstructure, illustrated at 15× in the photomicrograph of FIG. 4, shows fully developed liquid phase sintered spheres surrounded by an intermetallic rich diffusion layer and a solid state sintered matrix. The density was measured at approximately 14.6 grams per cubic centimeter with an elongation of between 1% and 4% and an ultimate tensile strength of between 5 ksi and 20 ksi. The yield was not measurable and fracture appeared to occur in the intermetallic region following the contours of the spheres. It is believed that the bulk properties of the composite can be further improved to approach those of the matrix phase through the use of secondary heat treatment.

Example 2

Figure 5:
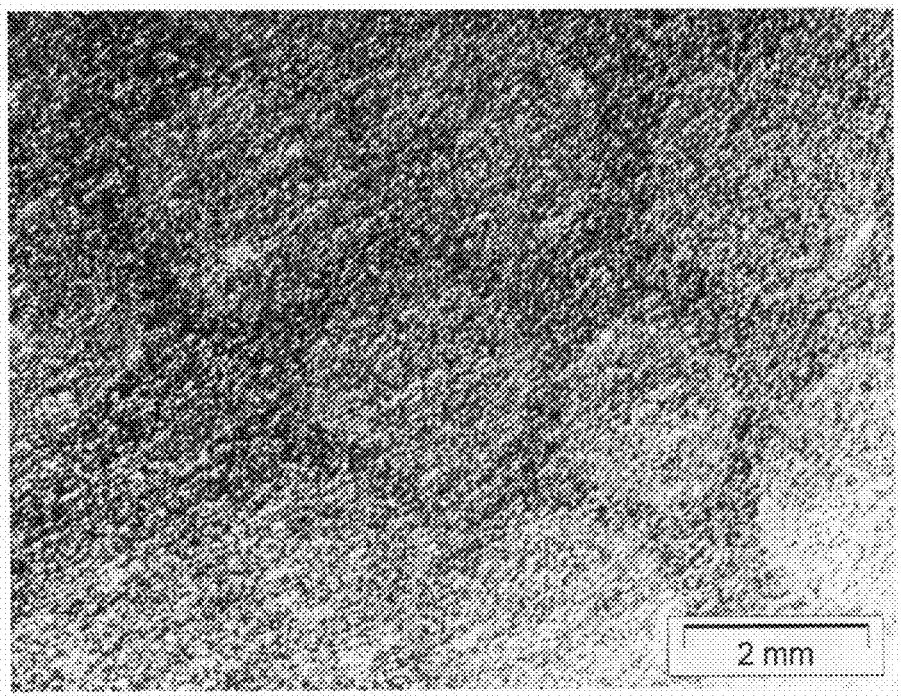
FIG. 5 is a photomicrograph illustrating the structure of a composite formed contrary to the invention.

The same spheres as used in Example 1 were embedded in a matrix of, by weight, 95.5% tungsten-3.15% nickel-1.35% iron, a conventional tungsten heavy alloy, and then sintered at 1,300° C. for five hours in hydrogen. Both the spheres and the matrix underwent liquid phase sintering and the microstructure of this sample is illustrated at 15× in FIG. 5. The microstructure shows liquid phase sintered spheres in a liquid phase sintered matrix with no apparent intermetallic regions formed. The density was 18.0 grams per cubic centimeter and fracture did not follow the contours of the spheres such that the spheres of this example would not be released on detonation of a fragmenting warhead.

It is apparent that the process and composites of the invention eliminate the problems of the prior art because both the embedded shapes and the matrix exhibit the same shrinkage but the embedded shapes undergo liquid phase sintering at the sintering temperature while the matrix is limited to solid state sintering such that two discreet phases remain present. The invention has a reduced amount of material requirements and a reduced number of processing steps required to form a finished product.

One or more embodiments of the present invention have been described. Nevertheless, it will be understood that various modifications may be made without departing from the spirit and scope of the invention. Accordingly, other embodiments are within the scope of the following claims.

What is claimed is:

1. A composite metal component comprising:

a metallic matrix that is a tungsten-base alloy containing one or more of iron, nickel and cobalt; and embedded shapes that are a tungsten-base alloy containing copper and have a predetermined shape dispersed throughout said matrix as a discontinuous phase wherein said embedded shapes have an incipient liquid phase sintering temperature less than an incipient liquid phase sintering temperature of said matrix and wherein said matrix has a microstructure commensurate with solid state sintering and said embedded shapes have a microstructure commensurate with liquid phase sintering.

2. The composite metal component of claim 1 wherein said predetermined shape is selected from the group consisting of rectangular blocks, cubes and spheres.

3. The composite metal component of claim 1 shaped as a nosecone for a fragmenting warhead.

4. A composite metal component comprising:

a matrix having a nominal composition by weight of 72.2% W, 19.5% Ni and 8.3% Fe and a microstructure commensurate with solid state sintering; and a discontinuous phase of embedded shapes having a predetermined shape dispersed throughout said matrix having a nominal composition by weight of 95% W, 3% Ni and 2% Cu and a microstructure commensurate with liquid phase sintering wherein an incipient liquid phase sintering temperature of said embedded shapes is less than an incipient liquid phase sintering temperature of said metallic matrix.

5. The composite metal component of claim 4 wherein said predetermined shape is selected from the group consisting of rectangular blocks, cubes and spheres.

6. The composite metal component of claim 5 shaped as a nosecone for a fragmenting warhead.

* * * * *